US005852858A

United States Patent [19]

Hallis et al.

[11] Patent Number: 5,852,858

[45] Date of Patent: Dec. 29, 1998

[54] NON-TOXIC FRANGIBLE BULLET

[75] Inventors: John M. Hallis, Buffalo; Richard W. Proulx, Forest Lake, both of Minn.

[73] Assignee: Federal-Hoffman Inc., Anoka, Minn.

[21] Appl. No.: 774,385

[22] Filed: Dec. 30, 1996

Related U.S. Application Data

[62] Division of Ser. No. 510,747, Aug. 3, 1995, Pat. No. 5,679,920.

[51] Int. Cl.[6] ..... B21K 21/06; F24B 12/34

[52] U.S. Cl. ..... 29/1.22; 102/506; 102/514

[58] Field of Search ..... 29/1.22, 1.23; 102/514, 529, 506

[56] References Cited

U.S. PATENT DOCUMENTS

| | | | |
|---|---|---|---|
| 1,240,293 | 9/1917 | Armstrong | 29/1.23 |
| 3,208,386 | 9/1965 | Schneider et al. . | |
| 5,375,529 | 12/1994 | Knight, Jr. et al. | 102/529 |
| 5,394,597 | 3/1995 | White | 29/1.22 |
| 5,528,989 | 6/1996 | Briese | 102/506 |
| 5,569,874 | 10/1996 | Nelson . | |

*Primary Examiner*—Frances Han
*Assistant Examiner*—Tisa Stewart
*Attorney, Agent, or Firm*—Schroeder & Siegfried, P.A.

[57] ABSTRACT

A non-toxic highly frangible training round bullet, and a method of making same, in which a plurality of segments of non-toxic metal selected from a group including zinc, iron, steel and copper are grouped or arranged within pressure-molding equipment and sufficient pressure is applied thereto to cause such segments to inter-engage and cohere, one to another, while being formed into a desired shape of bullet and retaining their individuality at least to a limited extent. Upon impact with a target, such a bullet fragments to a large extent along at least some of the original physical boundary lines of the original segments into new segments which are relatively small as compared to the size of the original segments. There is no substantial ricocheting or "bounce-back" activity associated with such fragmentation and, of course, there are no toxic effects.

11 Claims, 4 Drawing Sheets

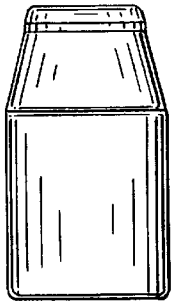
Fig.-1 (PRIOR ART)
Fig.-2A
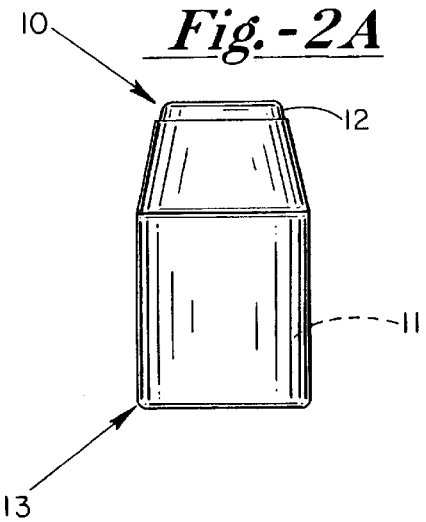
Fig.-2B
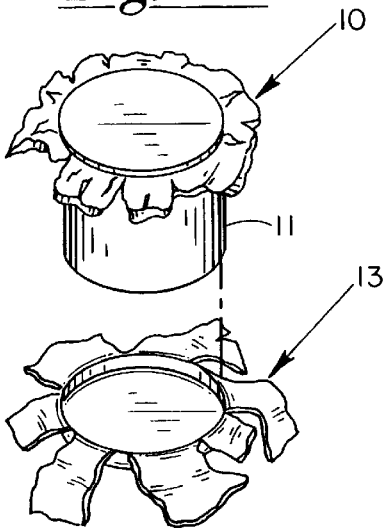
Fig.-3A
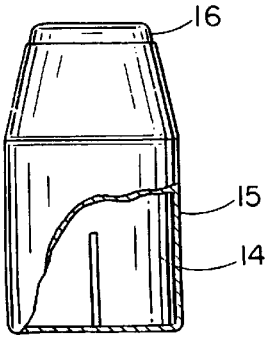
Fig.-3B
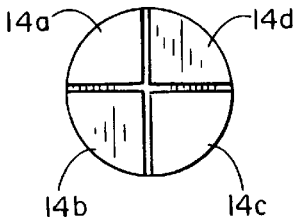
Fig.-3C
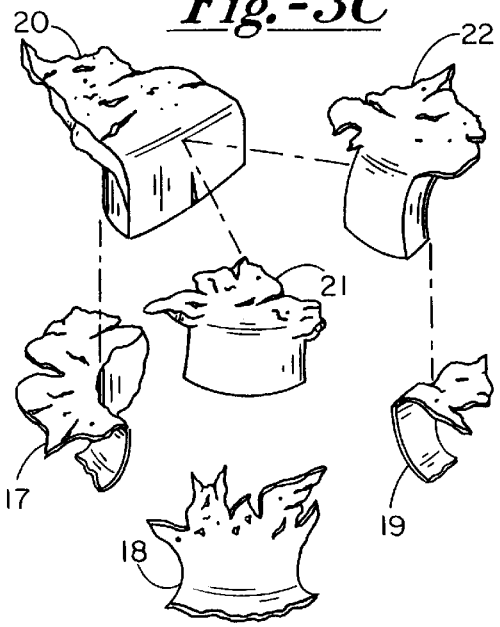

NON-TOXIC FRANGIBLE BULLET

DESCRIPTION

This application is a division of application Ser. No. 08/510,747, filed Aug. 3, 1995, now U.S. Pat. No. 5,679,920 and entitled "NON-TOXIC FRANGIBLE BULLET." It is also related to copending prior application Ser. No. 08/378,797, filed by John Hallis on Jan. 26, 1995, and now abandoned entitled "NON-TOXIC BULLET, both applications being owned by a common assignee.

BACKGROUND OF THE INVENTION

Law enforcement training officials, and others who fire live bullets within a confined area, experience continuing penetration problems, along with ricochets and "bounce-backs." For example, in training sessions of law enforcement officers, these problems are serious. Most of such firings are conducted with the targets at a distance approximately twenty-five (25) yards or less away from the shooter. Frequently, the fired bullets will ricochet dangerously or bounce back distances as great or greater than the distance between the target and the shooter. Also, some bullets ricochet and penetrate walls or ceilings, making their use unsafe. Penetration is a definite problem in target houses or shooting rooms, which frequently utilize hallways or relatively small rooms within which the firing is conducted.

In addition to the above problem, a need has been recognized in recent years for a non-toxic bullet, especially where the bullet is fired in large numbers within relatively confined areas such as target houses and shooting rooms. When lead bullets are utilized, this problem is particularly acute, for small particles of lead soon permeate the air within such confined area, causing serious health difficulties.

In an effort to obviate the above problems, we have experimented with the use of zinc bullets. We have found that,, typically, the all-zinc bullet will at least partially fragment when it strikes a ⅜ inch steel plate at right angles from a distance of 75 feet. These are the standard distance conditions utilized by the Federal Bureau of Investigation (FBI) in determining the suitability of bullets for its training needs. However, we also found that a portion of the core, having a weight of approximately 50% of the original bullet weight, most often bounces back at least as far as the shooter, or ricochets. Such occurrences present potential injury conditions for the law enforcement officer or others in the room who may be participating in the training program.

Various further efforts, as shown and described later herein, were made with somewhat improved, but not entirely satisfactory, results. These are shown in the drawings and explained in the specification which follows. Finally, as described hereinafter, we hit upon an idea which provides highly improved results which we believe adequately solves the above problems to our own satisfaction and to that of the FBI.

BRIEF SUMMARY OF THE INVENTION

Briefly, our invention-is comprised of a new non-toxic, highly frangible, bullet which is relatively safe for use as a training round in training exercises for law enforcement personnel, and of a method of making same. We have found that, if a plurality of separate segments of a non-toxic metal are grouped or arranged within pressure forming equipment utilizing bullet dies, and sufficient pressure is applied to form a bullet therefrom and cause such segments to interengage and cohere to each other, while retaining their individuality to a limited extent, such a bullet will fragment to a high degree upon striking a target. Such a bullet will not ricochet or "bounce-back" to any prohibitive extent. We prefer to utilize initial segments of a non-toxic metal selected from a group of such metals including zinc, iron, steel, or copper. Of this group, we prefer to utilize zinc segments.

We have had particular success by making the non-toxic bullet from strands or wires made of zinc, and twisted about each other along their longitudinal axes, so as to resemble a segment of rope, in appearance. We have found that such twisted zinc wires can still be recognized in some such finished bullets, and that they will disintegrate in a highly desirable manner upon striking a target. Such fragmentation takes place without appreciable ricocheting or "bounce-back" action being associated therewith.

DETAILED DESCRIPTION OF THE INVENTION

In considering this invention, it should be remembered that the present disclosure is illustrative only and the scope of the invention should be determined by the appended claims.

The primary object of the invention is to provide a non-toxic bullet which will fragment upon striking its target so as to obviate, or at least minimize, danger from ricocheting or "bounce back" of the bullet, or its fragments, after striking its target or other obstacle. As indicated previously, the FBI is strongly interested in accomplishing this goal, as are target houses and shooting rooms. In addition to these dangers, it is highly desirable to overcome the associated fume problems and the dangers of penetration.

These and other objects and advantages of the invention will more fully appear from the following description, made in connection with the accompanying drawings, wherein like reference characters refer to the same or similar parts throughout the several views, and in which:

FIG. 1 is a side elevational view of a bullet of the prior art;

FIG. 2A is a side elevational view of a bullet having a solid zinc core within a copper jacket;

FIG. 2B is a perspective view of the fragments of the bullet shown in FIG. 2A, after it was fired, and showing the nose portion having weight retention in excess of 50%;

FIG. 3A is a side elevational view of a zinc bullet having a slitted zinc core within a copper jacket;

FIG. 3B is a rear end elevational view of the zinc core of the bullet shown in FIG. 3A;

FIG. 3C is a perspective view of the fragments recovered from the bullet shown in FIG. 3A after it was fired against a steel plate target;

Figure 4A:
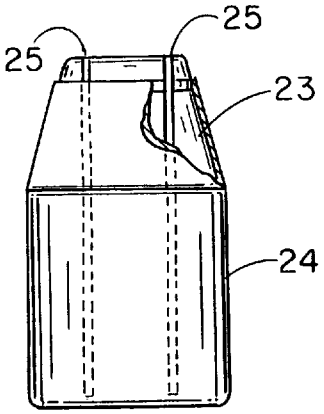
FIG. 4A is a side elevational view of a bullet with a zinc core, a weakened nose and copper jacket.

In our quest for a more suitable training round bullet, we were acutely aware of the need for such a bullet which would obviate the existing problem of toxic fumes in relatively confined areas where a large amount of firing of lead bullets has heretofore been practiced. We have found that a zinc bullet obviates the fume problem and, in addition, has sufficient weight to meet the requirements for use in a training program for law enforcement officials, etc. In view thereof, we have directed our efforts toward designing a zinc bullet which will overcome the other primary objections to the use of lead bullets, namely, ricocheting, "bounce-back," and penetration dangers. In our search for a bullet which would overcome these problems, we conducted numerous experiments with a view toward finding such a bullet.

The conventional lead bullet is shown in FIG. 1. Serious objection to the use of such bullets has been found, because involved in their use are the lead fumes which permeate the air, ricocheting upon striking a hard target, "bounce-back" to areas behind the individual firing the gun from which the bullet emerges, and serious penetration into adjoining areas after striking the target.

FIGS. 2A and 2B illustrate the results of one of the first experiments which we became engaged in, in our quest for a better training round bullet. As shown in FIG. 2A, this bullet core 10 has a cylindrical rear surface 11 and a forwardly tapering nose portion 12. A copper jacket 13 was is applied to the cylindrical portion of the core 10. We found that this type of bullet typically separates when striking a steel plate which is three-eighths (⅜) thick and fired upon from a distance of twenty-five (25) yards. Moreover, the core 10 retains approximately 50% of the weight of the initial core and bounces back or ricochets frequently. Such undesirable features endanger the personnel firing the gun and others in the room who may be participants in the training programs. The FBI -has established a requirement that the fragments from such a bullet must not be greater than 25% of the initial weight of the bullet, and consequently the bullet shown in FIGS. 2A and 2B were considered by us to be inadequate. FIG. 2B shows the fragmented copper jacket 13 and the fragmented core 10 after firing.

FIGS. 3A, 3B, and 3C show the results of our investigation and subsequent designing of another zinc bullet which we hoped would meet the established requirements. FIG. 3A is a side elevational view showing a zinc bullet core 14, the rear end portion of which is slitted so as to divide the same into four (4) segments, 14*a,* 14*b,* 14*c* and 14*d.* As shown, these slits extend approximately half -way throughout the vertical height of the cylindrical portion of the zinc core 14. The copper jacket 15 extended upwardly to a point adjacent the end surface of the nose portion 16. Upon firing this type of zinc bullet, we found that the frangibility of the bullet was improved, as shown in FIG. 3C. Fragments 17, 18 and 19 are fragments of the copper jacket 15, while fragments 20, 21 and 22 are fragments of the core 14. It can be seen that fairly good sized fragments, which were sufficiently heavy to seriously damage participants, were found after firing the bullet shown in FIG. 3A. While this bullet approaches suitability, we found that there remained a slight problem of over-penetration and, therefore, we explored further possibilities.

Figure 4B:
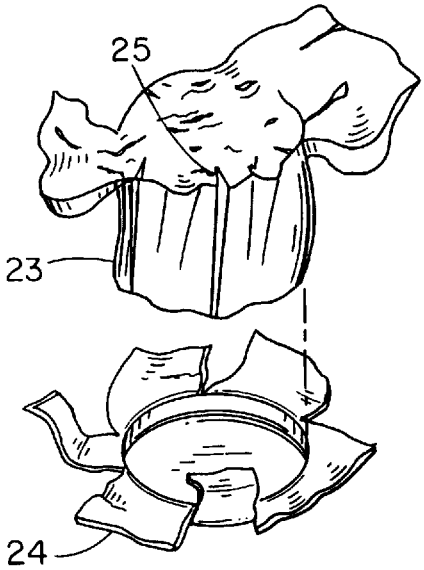
FIG. 4B is a perspective view of the partially fragmented nose portion and copper jacket of the bullet shown in FIG. 4A after it has been fired.

FIGS. 4A and 4B illustrate our further investigating and designing activities. FIG. 4A shows a side elevational view of a bullet having a zinc core 23 within a copper jacket 24 and having its outer portion weakened with slots, such as indicated by the numeral 25. These slots were formed on the outer area at each of the sides, while the more central portion remained intact. The four slots 25 extended the full length of the core 23, but extended only into the more peripheral portions. As shown, the core 23 was completely encased within the copper jacket 24 except for the extreme nose portion. We found that this core member 23 did not break up as well as that shown in FIG. 3A, and that fragments therefrom bounced back farther than the distance between the target and the individual firing the gun. The bullet shown in FIGS. 2A–2B and 3A–3C function similarly.

FIG. 4B shows the fragmented copper jacket 24, as well as the fragmented core 23. Here again, the fragments were too large to be considered safe for use as a training round.

Figure 5A:
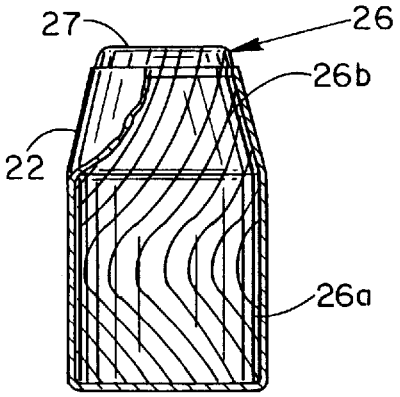
FIG. 5A is a side elevation, with portions broken away, of a bullet manufactured in accordance with our invention, and having a zinc core made of zinc wire segments surrounded at its rear by a copper jacket.
Figure 5B:
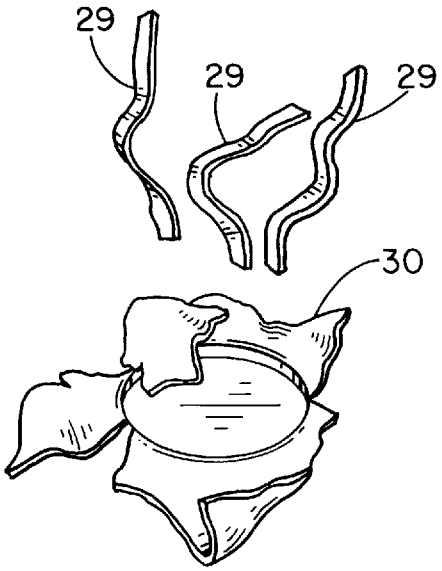
FIG. 5B is a perspective view of fragments of the zinc wire strands and copper jackets shown in FIG. 5A after the bullet shown therein was fired against a steel plate.

FIGS. 5A–5B show a bullet incorporating our invention. As shown in FIG. 5A, the core 26 of this all-zinc bullet is comprised of a plurality of zinc wire segments 27 which have been pressure-formed or swaged into the desired shape of the bullet, which is characterized by its cylindrical rear portion 26*a* and its inwardly tapering forward nose portion 26*b.* Wherever hereinafter we refer to an all-zinc bullet core, we are referring to a core made of approximately 99.8% zinc. A copper jacket 28 completely surrounds the cylindrical rear portion and the major portion of the inwardly tapering nose area of the core.

Figure 7A:
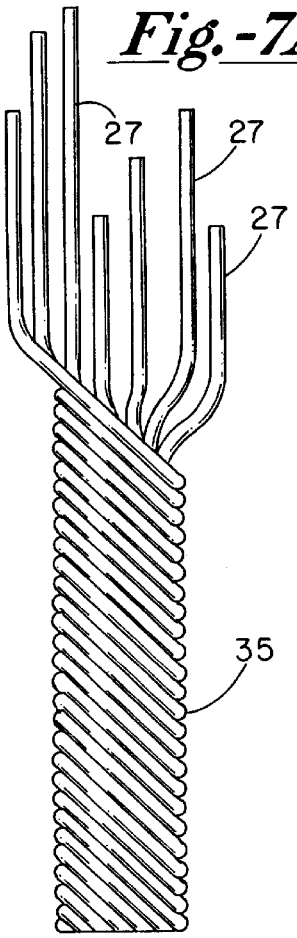
FIG. 7A is a side elevational view showing a plurality of zinc wire segments twisted along their longitudinal axes preparatory to swaging a section thereof into a bullet.

The core 26 is pressure-formed or swaged from a plurality or bundle of all-zinc wires 27 which have been twisted around each other, as shown in FIG. 7A. A segment of such a twisted roll is placed within the pressure-forming or swaging equipment, and pressure is applied thereto longitudinally of the section of twisted wires. Pressure is applied substantially parallel to the longitudinal axis of the twisted section. As a consequence, the shape of the individual wires 27 is distorted, as best shown in FIG. 5A, and the individual wires 27 inter-engage each other while retaining their individuality to a limited extent, as can be seen is visually from the exterior of the core, and as is shown in FIG. 5A.

The lines of FIG. 5A which outline the individual wires are darker than they appear to the eye when viewing the core. The outlines of the individual wires are not as readily apparent as they appear to be in FIG. 5A, and of course, become less distinct as the amount of pressure which is utilized in the swaging equipment is increased.

The core of the bullet is pressure-formed or swaged at pressures within the range of 36,000–50,000 psi. The preferred estimated pressure is 45,000 psi. These cores are formed at ambient temperatures.

The individual all-zinc strands of wire are approximately 0.062–0.064 inches in diameter. We use a varying number of strands, depending upon the size of the bullet to he manufactured. We have utilized within the range of 4–15 strands to form the twisted sections of wire preparatory to the swaging operation. We have found that a length of approximately ¾ inch is most appropriate. Such a section of twisted wire, when placed within the cavity of the swaging equipment, and when thereafter subjected to longitudinal pressure, will create a core of the type illustrated in FIG. 5A, and the distortion and inter-engagement of the individual wires 27 can be clearly seen. It appears that the distortion of the shapes of the individual wires, and their inter-engagement as a result thereof, play an important part in the retention of the shape of the core and the frangibility thereof upon striking its target. In any event, regardless of the cause, it is clear that a highly superior frangible bullet can be produced by this method. The fragments of wire 29 which result from the impact are substantially less than their original lengths and, of course, their weight is reduced proportionally. Also, the copper jacket fragments into a number of pieces 30. Each of the fragments of the copper jacket and of the zinc wire weigh less than 25% of the total weight of the core, and most, if not all, are found to weigh less than 10% of the overall core weight. This is a substantial improvement over any training round bullet heretofore known.

Figure 6A:
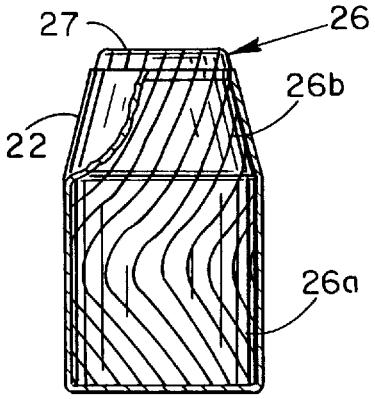
FIG. 6A is a side elevational view, with portions broken away, of a bullet made in accordance with our invention, showing the arrangement of the pressure-molded strands and a copper jacket.
Figure 6B:
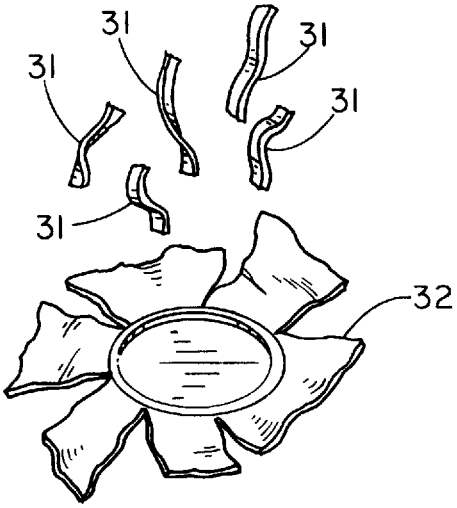
FIG. 6B is a perspective view of the fragments recovered after the bullet of FIG. 6A was fired into gelatin test material.

FIG. 6A is a side elevational view, with portions broken away, of a bullet made in accordance with our invention. The results of the longitudinal pressure being applied to the strands of zinc can be clearly seen. FIG. 6B is a perspective view of the fragments 31 and 32 recovered after the bullet, shown in FIG. 6A, was fired into gelatin test material. As shown in FIG. 6B, the fragmentation and the retention of the wire configuration again becomes clearly evident. The bullets shown in FIGS. 2A–2B, FIGS. 3A–3C, and FIGS. 4A–4B do not fragment in the manner shown in FIG. 6B, and tend to retain their original form and most, if not all, of their original weight. FIG. 6B illustrates the high degree of fragmentation of the zinc wires and of the copper jacket, as a result of the bullet striking its intended target.

FIG. 7A illustrates the manner in which the individual zinc wires are wound about each other in inter-engaging relation, preparatory to the formation of a bullet core of the invention disclosed and claimed herein. The illustration of FIG. 7A shows a total of seven (7) zinc wire strands as they are being twisted into a rope-like appearing section. A portion of the twisted section is severed and inserted into the swaging equipment, the length and the number of strands utilized being determined by the size of the bullet core to be manufactured.

Figure 7B:
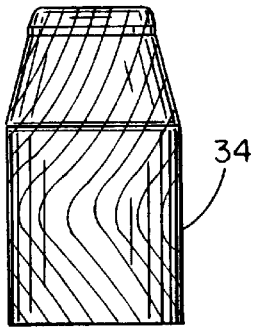
FIG. 7B is a side elevational view of a bullet core formed by swaging a section of the twisted zinc wire shown in FIG. 7A into the bullet shape, as shown.
Figure 7C:
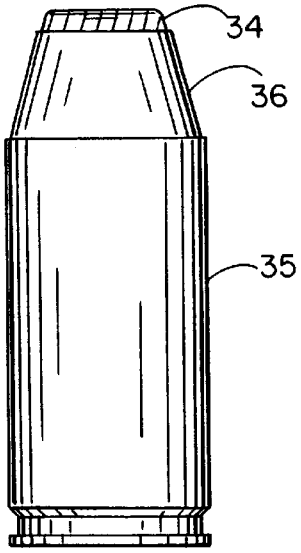
FIG. 7C is a side elevational view of a finished cartridge with a bullet made in accordance with our invention mounted in the mouth of its casing.

FIG. 7B shows the bullet core 34 resulting from the longitudinal compression of the twisted section 33. FIG. 7C shows the finished cartridge, which includes the brass casing 35 as well as the bullet core 34. The copper jacket 36 is shown in FIG. 7C protruding from the casing 35.

Figure 8:
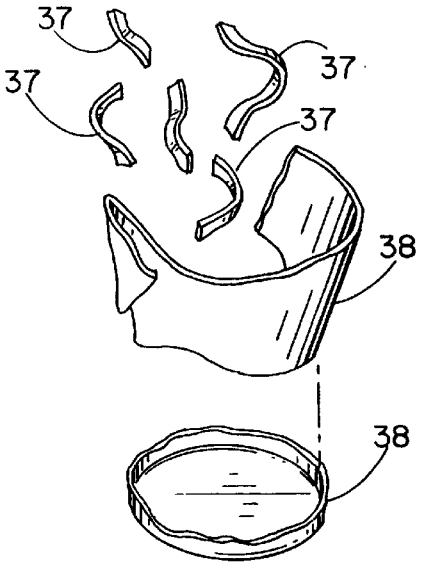
FIG. 8 is a perspective view showing the zinc wire and copper jacket fragments remaining of a bullet made in accordance with our invention, after it had been fired through sheet metal plate and into gelatin disposed immediately therebehind.

FIG. 8 shows the fragmenting results of firing one of our non-toxic frangible bullets through a 16 gauge sheet of metal, with gelatin positioned immediately therebehind. The bullet was fired from a distance of ten (10) feet, and fragmented within the gelatin six (6) inches behind the sheet of metal. It is considered that, in all likelihood, the initial impact of the bullet against the sheet of metal initiated the fragmentation, the evidence of which was found only six (6) inches behind the metal sheet. Evidence of the fragmentation could not be found at the bullet hole in the sheet of metal, and some of the punctured material was carried into the gelatin by the bullet. The diameter and shape of the bullet was reflected in the bullet hole in the sheet metal disk. As can be seen by reference to FIG. 8, the individual wire fragments 37 are relatively small, and the copper jacket 38 also fragmented to a high degree. The results of this test suggest that our non-toxic frangible bullet substantially reduces penetration, as compared to the prior art.

In conclusion, it appears evident that we have successfully developed a highly frangible bullet core, and consequently a bullet, which will fragment to a high degree upon impact upon its target. This fragmentation greatly diminishes the size of its fragments so as to meet the requirements of the trade and the FBI, so as to obviate to an almost insignificant extent the problems heretofore experienced in training rounds with respect to ricocheting, penetration, "bounce back," and toxic fumes, as experienced in the prior art. This has been accomplished without any adverse effects with respect to accuracy.

Although we will continue with our experiments to further improve, if possible, these improved training rounds, we know from our experiments that we have substantially improved the physical characteristics of training rounds as a whole. We know that heretofore, when training rounds were fired against a steel plate ⅜ inch thick from a distance of 25 yards, fragments from the bullets could be recovered all the way back to the shooting position and therebehind. In addition, the bullets would ricochet and penetrate ceilings and adjacent walls. We also know that, by the use of the bullets described herein, the farthest back from the target that we have been able to recover fragments has been at ten (10) feet. This is obviously a substantial safety feature improvement. These results have been experienced while utilizing the same gun with the same casings and amount and type of propellant.

Wherever herein the term "copper" is used, it is intended to refer to either pure copper or one of the copper alloys commonly used in the ammunition trade.

It will, of course, be understood that various changes may be made in the form, details, arrangement and proportions of the parts without departing from the scope of the invention which comprises the matter shown and described herein and set forth in the appended claims.

We claim:

1. In a method of manufacturing a non-toxic highly frangible training round bullet core which is relatively safe with respect to ricochets and bounce-back actions, and therefore being of use in training exercises for law-enforcement personnel as a relatively safe training round, comprising:

(a) selecting a plurality of segments of a non-toxic metal selected from a group of non-toxic metals consisting of zinc, iron, steel and copper, said segments having original physical boundaries, (b) twisting at least some of said segments about other of said segments into inter-engaging relation, and (c) swaging said twisted segments of non-toxic metal into a twisted mass having the shape of a bullet having a generally cylindrical rear portion and a generally truncated nose portion, with sufficient pressure to cause said segments to distort, inter-engage and cohere one to another while retaining their individuality at least to a limited extent, and to thereby cause said individual segments, upon said bullet core striking a target, to fragment along at least some of the original physical boundaries of said segments into separate, discrete and relatively small fragments which are smaller than the original size of said segments.

2. In a method of fabricating a non-toxic highly frangible training round bullet core for use as part of a relatively safe training round in training exercises for law-enforcement personnel, comprising, (a) selecting a plurality of slender, elongated segments of a non-toxic metal selected from a group of non-toxic metals consisting of zinc, iron, steel and copper, said segments having original physical boundaries which define their shapes;

(b) twisting said segments of metal into inter-engaging relation for pressure-molding same into the shape of a bullet, and (c) pressure-molding said twisted segments into the shape of a bullet core having a generally cylindrical rear portion, and a generally truncated nose portion, with sufficient pressure to cause said segments to distort, further inter-engage and cohere to each other while retaining their individuality at least to a limited extent, and to thereby cause said individual segments, upon said bullet core striking a target, to fragment along at least some of the original physical boundaries of said segments into separate, discrete and relatively small fragments which are smaller than the original size of said segments.

3. The method defined in claim 2, wherein said elongated segments are selected from a group of non-toxic metals consisting of zinc and copper.

4. The method defined in claim 2, wherein said elongated segments are consisting of zinc.

5. The method defined in claim 2, wherein said elongated segments are consisting of copper.

6. The method defined in claim 2, and applying the pressure of the pressure-molding longitudinally to the group of elongated segments to so molds same into the shape of a bullet core.

7. The method defined in claim 2, and twisting the elongated segments about each other into an interengaging relation prior to pressure-molding same into the shape of a bullet core, and thereafter applying the pressure of the pressure-molding longitudinally of the elongated segments.

8. A method of fabricating a non-toxic highly frangible bullet core for use as part of a relatively safe training round comprising:

(a) providing a plurality of segments of zinc, said segments having original physical boundaries which define their shapes;

(b) twisting a plurality of said segments into inter-engaging and cohering relation with other of said segments; and (c) pressure-molding said inter-engaged segments into the shape and size of a bullet core having a generally cylindrical rear portion and a generally truncated nose portion, with sufficient pressure to cause said segments to distort, further inter-engage, and cohere to each other and to assume said bullet core shape while retaining their individuality at least to a limited extent and to thereby cause said individual segments, upon said bullet core striking a target, to fragment along at least some of the original physical boundaries of said segments into separate, discrete and relatively small fragments which are smaller than the original size of said segments.

9. A method of fabricating a non-toxic highly frangible bullet core for use as part of a relatively safe training round comprising:

(a) providing a plurality of segments of zinc, said segments having original physical boundaries which define their shapes;

(b) twisting a plurality of said segments into inter-engaging relation and thereby causing same to cohere each to the other, and (c) pressure-molding said inter-engaged segments into the shape of a bullet core having a generally cylindrical rear portion and a nose portion with sufficient pressure to cause said segments to distort, further inter-engage, and cohere to each other and to assume said bullet core shape while retaining their individuality at least to a limited extent and to thereby cause said individual segments, upon said bullet core striking a target, to fragment along at least some of the original physical boundaries of said segments into separate, discrete and relatively small fragments which are smaller than the original size of said segments.

10. A method of fabricating a non-toxic highly frangible bullet core for use as part of a relatively safe training round comprising:

(a) selecting a plurality of segments of a non-toxic metal, selected from a group of non-toxic metals consisting of zinc, copper, iron and steel, said segments having original physical boundaries which define their shapes;

(b) wrapping a plurality of said segments about other of said segments into inter-engaging relation therewith and thereby causing same to cohere each to the others, and (c) pressure-molding said inter-engaged segments into the shape of a bullet core having a generally cylindrical rear portion and a generally truncated nose portion, with sufficient pressure to distort, further inter-engage, and cohere to each other and to cause said segments to assume said bullet core shape while retaining their individuality at least to a limited extent and to thereby cause said individual segments, upon said bullet core striking a target, to fragment along at least some of the original physical boundaries of said segments into separate, discrete and relatively small fragments which are smaller than the original size of said segments.

11. The method of fabricating a non-toxic highly frangible bullet core defined in claim 8, wherein said segments consist of approximately 99.8% zinc, and encasing said cylindrically shaped rear portion within a copper jacket.

* * * * *

UNITED STATES PATENT AND TRADEMARK OFFICE

CERTIFICATE OF CORRECTION

PATENT NO. : 5,852,858

DATED : December 29, 1998

INVENTOR(S) : John M. Hallis, et. al.

It is certified that error appears in the above-identified patent and that said Letters Patent is hereby corrected as shown below:

Column 1, line 59, delete "invention-is" and insert --invention is--.

Column 1, line 66, delete "interen-" and insert --inter-en--.

Column 3, line 54, delete "FBI -has" and insert --FBI has--.

Column 7, claim 6, line 32, delete 'to so molds" and insert -- to so mold--.

Signed and Sealed this

Sixth Day of April, 1999

*Attest:*

Q. TODD DICKINSON

*Attesting Officer*

*Acting Commissioner of Patents and Trademarks*